US007219804B2

(12) United States Patent
Simmons et al.

(10) Patent No.: US 7,219,804 B2
(45) Date of Patent: May 22, 2007

(54) FLOTATION PROCESSING INCLUDING RECOVERY OF SOLUBLE NONFERROUS BASE METAL VALUES

(75) Inventors: Gary L. Simmons, Castle Rock, CO (US); John C. Gathje, Longmont, CO (US)

(73) Assignee: Newmont USA Limited, Denver, CO (US)

( * ) Notice: Subject to any disclaimer, the term of this patent is extended or adjusted under 35 U.S.C. 154(b) by 471 days.

(21) Appl. No.: 10/816,346

(22) Filed: Apr. 1, 2004

(65) Prior Publication Data

US 2005/0045528 A1 Mar. 3, 2005

Related U.S. Application Data

(60) Provisional application No. 60/497,578, filed on Aug. 26, 2003.

(51) Int. Cl.
*B03D 1/02* (2006.01)

(52) U.S. Cl. ..... 209/166; 423/26; 423/27; 423/29; 423/101; 423/140

(58) Field of Classification Search ..... 209/166, 209/167; 423/26, 27, 29, 101, 140
See application file for complete search history.

(56) References Cited

U.S. PATENT DOCUMENTS

| | | | | |
|---|---|---|---|---|
| 809,959 | A | 1/1906 | Kirby | |
| 821,516 | A | 5/1906 | Lovett | |
| 1,045,970 | A | 12/1912 | Greenway | |
| 1,505,323 | A | 8/1924 | Eberenz | |
| 2,048,370 | A | 7/1936 | Brinker | |
| 2,052,214 | A | 8/1936 | Brinker | |
| 2,070,076 | A | 2/1937 | Brown | |
| 3,655,044 | A | 4/1972 | Delaney | 209/167 |
| 3,834,896 | A | 9/1974 | Eisele et al. | 75/112 |
| 4,571,263 | A | 2/1986 | Weir et al. | 75/101 R |
| 4,571,264 | A | 2/1986 | Weir et al. | 75/101 R |

(Continued)

FOREIGN PATENT DOCUMENTS

| | | |
|---|---|---|
| AU | B-69283/87 | 1/1990 |

(Continued)

OTHER PUBLICATIONS

Ferron, C.J. et al., "Mineralogy and Selective Upgrading of a Gold-Platinum Flotation Concentrate", EPD Congress 1994, Minerals, Metals & Materials Society, (1994), pp. 21-32.

(Continued)

*Primary Examiner*—Thomas M. Lithgow
(74) *Attorney, Agent, or Firm*—Marsh Fischmann & Breyfogle LLP

(57) ABSTRACT

A method of flotation processing ores and other mineral materials containing soluble nonferrous base metal and sulfide minerals involves dissolving the soluble nonferrous base metal and precipitating the soluble nonferrous base metal in the form of a floatable precipitate that is collected as part of a sulfide concentrate. The use of an oxygen-deficient flotation gas, such as nitrogen gas, promotes the precipitation of the floatable precipitate. A method for removing dissolved nonferrous base metal from solution involves contacting the solution with a particulate containing sulfide minerals under conditions promoting precipitation of the nonferrous base metal onto the sulfide mineral.

47 Claims, 3 Drawing Sheets

U.S. PATENT DOCUMENTS

| | | | | |
|---|---|---|---|---|
| 4,605,439 | A | 8/1986 | Weir | 75/118 |
| 4,797,202 | A | 1/1989 | Klimpel et al. | 209/166 |
| 5,013,359 | A | 5/1991 | Fair et al. | 75/744 |
| 5,074,993 | A | 12/1991 | Kerr et al. | 209/167 |
| 5,245,110 | A | 9/1993 | Van Dijk et al. | 585/946 |
| 5,411,148 | A | 5/1995 | Kelebek et al. | 209/166 |
| 5,653,945 | A | 8/1997 | Gathje et al. | 423/26 |
| 5,837,210 | A | 11/1998 | Simmons et al. | 423/26 |
| 5,855,770 | A | 1/1999 | Clark et al. | 209/166 |
| 6,032,805 | A | 3/2000 | Clark et al. | 209/164 |
| 6,036,025 | A | 3/2000 | Clark et al. | 209/164 |
| 6,041,941 | A * | 3/2000 | Newell et al. | 209/164 |
| 6,044,978 | A | 4/2000 | Newell et al. | 209/164 |
| 6,092,666 | A | 7/2000 | Clark et al. | 209/164 |
| 6,210,648 | B1 | 4/2001 | Gathje et al. | 423/26 |

FOREIGN PATENT DOCUMENTS

| | | |
|---|---|---|
| AU | A-39027/95 | 5/1996 |
| CA | 1070034 | 1/1980 |
| FR | 2608462 | 6/1988 |
| SU | 833320 | 5/1981 |

OTHER PUBLICATIONS

Penberthy, C.J. et al., "The Recovery of Platinum-Group Elements From the UG-2 Chromitite, Bushveld Complex—A Mineralogical Perspective", Mineralogy and Petrology, vol. 68, pp. 213-222 (2000).

Rybas, V. et al., "Ecological Outlook for the New Technology of the Copper-Nickel Ore Benefication Based on the Flotation with Nitrogen", XVIII Internation Mineral Processing Congress, Sidney-Australia, pp. 997-998, May 23-28, 1993.

Rybas, V.V. et al., "The Use of Nitrogen in the Benefication of Copper-Nickel Ores", USSR, Tsvetnaia Metallugica, Moscow (Non-Ferrous Metallurgy) 1989 (2), pp. 112-114. (English translation provided).

Rybas, V.V. et al., "Industrial Use of Nitrogen in Ore Flotation in the Norilsk Benefication Plant", Tsvetnaia Metallurgila, Moscow (Non-Ferrous Metallurgy) 1990 (9), pp. 93-95. (English translation provided).

Simmons, G.L., "Flotation of Auriferous Pyrite Using Santa Fe Pacific Gold's N2 TEC Flotation Process," SME Annual Meeting, Denver Colorado, Feb. 24-27, 1997.

Talkington, Raymond W. et al., "Trends in the Distribution of the Precious Metals in the Lac-Des-Iles Complex, Northwestern Ontario", Canadian Mineralogist, vol. 22, pp. 125-136 (1984).

Tarkian, M. "Platinum-Group Elements In Porphyry Copper Deposits: A Reconnaissance Study, Mineralogy and Petrology", vol. 65, pp. 161-183 (1999).

de Villiers, J.P.R. et al., A Mineraological Investigation of Ores from the Merensky Reef and Their Flotation Products National Institute for Metallurgy, Report No. 1966, Mar. 31, 1978, Reissued Mar. 31, 19/80.

Rao et al., "Electrochemistry in the Plant", Innovations in Flotation Technology, pp. 57-100 (1992, Kluwer Academic Publishers, P Mavros and K A Matis (eds.)

Bogdanov, "Current Advances in the Theory and Practice of Flotation: Research Work Performed at the Mekhanobr Institute", Advances in Mineral Processing—edited by R. Sormasundaran (1986), pp. 255-259, no month.

Nakazawa et al., "Effect of Pyrite-Pyrrhotite Contact on Their Flotabilities", Min erals and Metallurgical Processing, Nov. 1985, pp. 206-211.

Burger. "Froth Flotation Developments: This Industry Workhorse Goes From Strength to strength, "E&MJ (Sep. 1983) pp. 67-75.

Onstott et al. "By-Product Molybdenum Flotation From Copper Sulfide Concentrate With Nitrogen Gas In Enclosed Wemco Nitrogen Flotation Machines," Preprint No. 84-65 (1984) Society of Mining Engineers of AIME, pp. 1-8.

Berglund et al. "Influence of Different Gases in Flotation of Sulphide Minerals, "Proceedings of An Engineering Society Foundation Conference on Advances in Coal and Mineral Processing Using Flotation, (1989) pp. 71-76, Society for Mining Metallurgy and Exploration, Inc., Littleton, Colorado.

Martin et al. "Complex Sulphide Ore Processing with Pyrite Flotation by Nitrogen," International Journal of Mineral Processing, 26 (1989) pp. 95-110, Elsevier Science Publishers B.V., Amsterdam.

Jones. "Some Recent Developments in the Measurement and Control of Xanthate, Perxanthate, Sulphide, and Redox Potential in Flotation." International Journal of Mineral Processing, 33 (1991) pp. 193-205, Elsevier Science Publishers B.V. Amsterdam.

Berglund. "Pulp Chemistry in Sulfide Mineral Flotation." International Journal of Mineral Processing, 33 (1991) pp. 21-31. Elsevier Science Publishers B.V. Amsterdam.

Klymwsky et al. "The Role of Oxygen in Xanthate Flotation of Galena, Pyrite and Chalcopyrite." CIM, Bulletin for Jun. pp. 683-688 (1970).

Rao and Finch. "Galvanic Interaction Studies on Sulphide Minerals." Canadian Metallurgical Quarterly, vol. 27, No. 4, pp. 253-259 (1988).

Rao et al. "Possible Applications of Nitrogen Flotation of Pyrite." Minerals, Materials and Industry (ed. M.T. Jones). Institute of Mining and Metallurgy. pp. 285-293 (1990).

Rao et al. "Adsorpotion of Amyl Xanthate at Pyrrhotite in the Prescence of Nitrogen and Implications in Flotation." Can. Metall. Q., vol. 30, No. 1, pp. 1-6 (1990).

Xu et al. "Sphalerite Reverse Flotation Using Nitrogen." Proc. Electrochem Soc., vol. 91-17, Proc. Int. Symp. Electrochem Miner. Met. Process. III, 3rd, pp. 170-190 (1992).

Van Deventer et al. "The Effect of Galvanic Interaction on the Behaviour of the Froth Phase During the Flotation of a Complex Sulphide Ore." Minerals Engineering, vol. 6, No. 12, pp. 1217-1229 (1993).

Author unknown, title unknown, Chapter IV, Gases and Aeration, pp. 63-70, date unknown.

Plaskin et al. "Role of Gases in Flotation Reactions." Academy of Sciences, U.S.S.R. Moscow, pp. 361-367, date unknown.

Kongolo et al. "Improving the Efficiency of Sulphidization of Oxidized Copper Ores by Column and Inert Gas Flotation." Proceedings of Copper 95-Cobre 95 International Conference, vol. II, The Metallurgical Society of CIM, pp. 183-196. 1995.

* cited by examiner

FLOTATION PROCESSING INCLUDING RECOVERY OF SOLUBLE NONFERROUS BASE METAL VALUES

CROSS-REFERENCED TO RELATED APPLICATIONS

This application claims a benefit of priority under 35 U.S.C. Section 119 to U.S. Provisional Patent Application Ser. No. 60/497,578 entitled "FLOTATION PROCESSING INCLUDING RECOVERY OF SOLUBLE NONFEROUS BASE METAL" filed Aug. 26, 2003, the entire contents of which are incorporated herein by reference as it set forth herein in full.

FIELD OF THE INVENTION

The present invention involves flotation processing of nonferrous base metal-containing ore materials during mineral processing operations.

BACKGROUND OF THE INVENTION

A variety of techniques are used to recover nonferrous base metals from base metal ores. For some ores, the base metals of interest are directly leached from the ore into a leach solution, and the base metals are then removed from the leach solution to recover base metal values. For example, some copper ores are processed by dump leaching. Dump leaching involves leaching copper from the ore into an acidic leach solution. The copper is then recovered from the leach solution, such as by solvent extraction and electrowinning. If present, other base metals dissolved into the leach solution may be recovered before or after removal of the copper. For example, if the leach solution contains an appreciable quantity of dissolved zinc, the zinc may be recovered, following recovery of the copper, by solvent extraction or selective precipitation.

One problem with dump leaching is that the process results in a low recovery of copper when the ore contains significant amounts of copper that are not in an acid soluble form. Consequently, the dump leach process is normally limited to use on ores with appreciable quantities of acid soluble copper. Also, the solvent extraction process is expensive and not economic for use with many ores.

Another method of recovering base metals from base metal ores is to prepare a base metal ore concentrate by flotation and then further process the base metal ore concentrate, such as by smelting. During the flotation, it is important to produce a concentrate of sufficiently high grade for the smelting operation without losing excessive quantities of the valuable base metal to the flotation tail. For some ores, there is an added complication when significant quantities of the valuable base metal in the ore are in a form that is soluble in the flotation liquid. During flotation, such soluble base metals are susceptible to dissolving into the flotation liquid and then precipitating in a non-floatable form, such as a nonfloatable oxide or hydroxide precipitate. This nonfloatable precipitate is then lost to the flotation tail, representing significant loss of base metal value. One approach to address this problem is to pre-leach the ore to dissolve the soluble base metal, and separately remove the soluble base metal from the leach solution. For example, a copper ore may be pre-leached with water or with an acidic leach solution to dissolve soluble copper. The soluble copper is then recoverable from the leach solution by solvent extraction and electrowinning, in the same way as previously discussed for dump leach operations. However, the additional pre-leach process is expensive and is often not economical.

Another proposed method to recover base metals is pressure oxidization, especially when a significant portion of the base metal value is contained in sulfide minerals. During pressure oxidation, a slurry of the ore is subjected to high temperature and high pressure in an autoclave in the presence of oxygen gas, causing decomposition of sulfide minerals and permitting most or all of the base metals of interest to dissolve into aqueous liquid of the slurry. For example, this process has been proposed especially for processing copper ores that contain a substantial amount of primary copper sulfide minerals, such as chalcopyrite. One consideration for pressure oxidation as a processing option is that it is expensive. Also, it is often desirable to first prepare a sulfide concentrate from the ore prior to pressure oxidation, to increase sulfide sulfur content in the autoclave feed to provide sufficient fuel for the pressure oxidation. If the ore contains significant quantities of base metal in soluble form, there is a potential for significant losses of base metal values during flotation, in a manner as discussed above. The soluble base metal content could be removed prior to flotation by pre-leaching of the ore, but as noted above such pre-leaching is expensive and often not economical.

SUMMARY OF THE INVENTION

One aspect of the present invention relates to flotation processing of sulfide ores containing soluble copper to prepare a sulfide concentrate. The inventors have recognized that flotation parameters can be controlled in a manner so that soluble copper contained in the sulfide ore, and that dissolves during the flotation, may be precipitated in a floatable form that can be concentrated in the flotation concentrate along with sulfide minerals. One important flotation parameter is the amount of oxygen present during flotation. It is believed that reducing or eliminating the presence of reactive oxygen during the flotation promotes precipitation of the soluble copper in metallic form on the surface of iron-containing sulfide grains, and especially on pyritic mineral grains, that then float and are collected with the concentrate. The amount of reactive oxygen in the system may be controlled using one or more of a variety of process controls. For example, an oxygen deficient gas (e.g. nitrogen) may be used as the flotation gas instead of air. Also, the use of an oxygen deficient blanketing gas during comminution and conditioning that occurs prior to flotation also helps to reduce the amount of reactive oxygen that would otherwise be introduced into the system from ambient air. In addition to controlling oxygen levels, controlling the pH of the slurry is also important for enhanced performance of the method of the invention. In a preferred implementation, the flotation is conducted at an acidic pH, and more preferably in an acidic pH range of from pH 2 to pH 6.5. The pH may be controlled, for example, by additions of acid or base reagents, as necessary. The soluble copper contained in the mineral material being processed may be a primary metal value in the mineral material or may be a by-product metal value. For example, the mineral material may be a precious metal ore containing a by-product copper value. As another example, the mineral material may be a copper ore, in which the copper is the primary metal value. Also, although the invention is described herein with primary reference to processing of mineral materials containing soluble copper, the method is also applicable to processing mineral materials with other soluble nonferrous base metal, such as ores containing soluble cadmium and/or cobalt, with or without the presence also of soluble copper. These other soluble nonferrous base metals could be the primary or by-product metal values in the mineral material.

Another aspect of the present invention relates to removal of dissolved copper, or other nonferrous base metal, from a solution in which the nonferrous base metal is dissolved. The solution containing the dissolved nonferrous base metal is contacted with a sulfide mineral material. During the contacting, passage of an oxygen-deficient gas through the solution promotes the precipitation of the dissolved nonferrous base metal as a floatable precipitate, such as in the form of metallic nonferrous base metal that is loaded onto the sulfide mineral material. The loaded sulfide mineral material may then be collected for further processing. In one implementation, the solution containing the dissolved nonferrous base metal may be leach solution from prior leaching of an ore material, and the sulfide mineral material contacted with the solution may be provided in the form of a sulfide concentrate prepared from another ore material. For example, one copper ore could be subjected to a dump leach to dissolve soluble copper from that ore, and another copper ore could be subjected to flotation to prepare the sulfide concentrate. Following precipitation of copper from the solution onto the sulfide concentrate, the loaded sulfide concentrate may then be recovered and subjected to further processing. For example, the ore material subjected to a dump leach could be a lower-grade ore not suitable for concentration by flotation, and the other ore material could be a higher-grade ore for which preparation of a concentrate is more economically feasible. As another example, the ore material subjected to a dump leach could contain a much larger soluble copper content that is amenable to leaching than the other ore that is concentrated by flotation.

BRIEF DESCRIPTION OF THE INVENTION

DETAILED DESCRIPTION

One aspect of the present invention involves flotation processing a mineral material containing soluble nonferrous base metal. As used herein, "nonferrous base metal" refers to a base metal other than iron, and "soluble nonferrous base metal", refers to nonferrous base metal that is susceptible of being dissolved into flotation liquid during the flotation processing. This soluble nonferrous base metal is generally the nonferrous base metal content of the mineral material that would be leachable from the mineral material into a leach solution if the mineral material were subjected to a pre-leach step prior to the flotation. A preferred mineral material for processing according to the method also includes significant nonferrous base metal values contained in sulfide minerals that are not susceptible to being dissolved into flotation liquid during the flotation processing, and these sulfide minerals are concentrated in the flotation concentrate prepared during the flotation processing.

Figure 1:
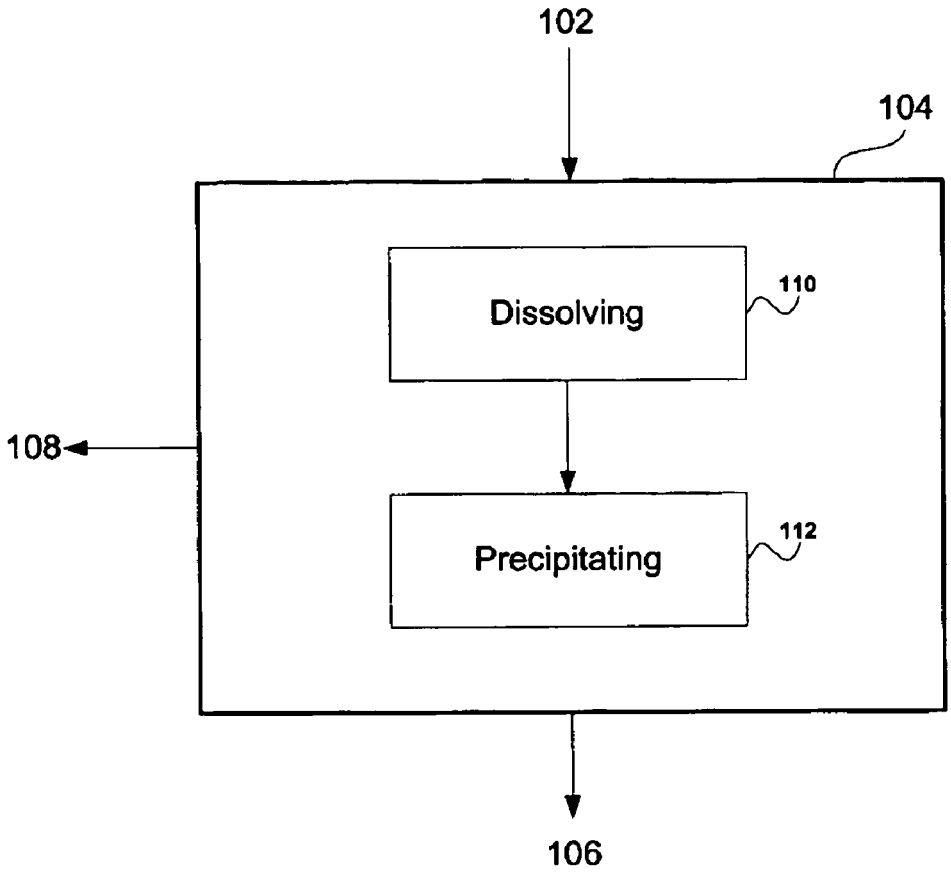
FIG. 1 illustrates a generalized process diagram of an embodiment of the present invention involving flotation of a base metal sulfide ore that contains appreciable nonferrous base metal values in soluble form.

FIG. 1 illustrates a generalized process diagram of one implementation of the method, which will be described with respect to processing a mineral material that is a nonferrous base metal ore containing nonferrous base metal sulfide minerals that are substantially insoluble during flotation and also containing soluble nonferrous base metal. As shown in FIG. 1, a feed 102 of the mineral material is subjected to flotation processing 104 to prepare flotation concentrate 106 and flotation tail 108. The flotation concentrate 106 typically contains at least a majority of the nonferrous base metal from the mineral material feed 102, and the flotation concentrate 106 is enriched in, and the flotation tail 108 is correspondingly depleted in, the sulfide minerals and the nonferrous base metal, relative to the mineral material in the feed 102.

During the flotation processing 104, a flotation gas is passed through a slurry comprising particles of the mineral material slurried in a liquid, typically an aqueous liquid. The flotation concentrate 106 is typically collected from a froth forming at the top of the slurry, and the flotation tail 108 is typically removed from near the bottom of the slurry.

As illustrated in FIG. 1, with this implementation of the invention the flotation processing 104 comprises dissolving 110 and precipitating 112 soluble nonferrous base metal. During the dissolving 110, at least some, preferably most and more preferably substantially all, soluble nonferrous base metal in the feed 102 is dissolved into the flotation liquid. During the precipitating 112, at least some, preferably most and more preferably substantially all, of the soluble nonferrous base metal that is dissolved from the feed during the dissolving 110 is precipitated from the flotation liquid in the form of a floatable precipitate. At least a portion, preferably at least a majority and more preferably substantially all, of the floatable precipitate is collected as part of the flotation concentrate 106. In this way, at least a portion, preferably at least a majority and more preferably substantially all, of the soluble nonferrous base metal in the feed 102 is recovered in the flotation concentrate 106.

To promote formation of the floatable precipitate, the composition of the flotation gas should preferably be controlled so that the flotation gas is oxygen-deficient. By oxygen-deficient it is meant that the flotation gas is either substantially free of oxygen gas or, if the flotation gas does contain some oxygen gas, the volume fraction of oxygen gas in the flotation gas is smaller, and preferably much smaller, than the volume fraction of oxygen gas contained in ambient air. By ambient air, it is meant the air in the ambient environment at the location where the flotation processing 104 is being conducted. Ambient air will typically have an oxygen gas content of approximately 21 volume percent. However, with the present invention it is preferred that the flotation gas introduced into the flotation slurry comprise no greater than 15 volume percent, more preferably no greater than 10 volume percent, even more preferably no greater than 5 volume percent, and still more preferably no greater than 2 volume percent oxygen gas. In a preferred embodiment, the flotation gas consists essentially of only inert gas, or at least has a very high content of inert gas. By inert gas it is meant gas content in the flotation gas that is substantially nonreactive during the flotation processing. Examples of some inert gas components include nitrogen, argon, helium and carbon dioxide. The inert gas content of the flotation gas may be a single inert gas component or a mixture of two or more inert gas components. In one embodiment, in addition to being oxygen-deficient, as described above, the flotation gas also comprises at least 85 volume percent, more preferably at least 90 volume percent, even more preferably at least 95 volume percent and most preferably at least 98 volume percent inert gas, and particularly preferred is for the flotation gas to consist essentially of only inert gas. In a particularly preferred implementation, the noted inert gas content of the flotation gas is made up mostly or substantially entirely of nitrogen gas.

Without being bound by theory, but to aid in the understanding of the invention, it is believed that the use of an oxygen-deficient flotation gas has the effect of starving the flotation process of free oxygen, which tends to be very reactive with the soluble nonferrous base metal that dissolves in the flotation liquid. When present, such free oxygen often reacts with the dissolved nonferrous base metal to form base metal oxide and/or hydroxide precipitates, which oxide and hydroxide precipitates do not readily float during flotation. In the absence of free oxygen, as the concentration of soluble nonferrous base metal dissolved in the flotation liquid increases, the nonferrous base metal tends to precipitate from the solution in a metallic form that will coat or otherwise adhere to the surface of sulfide minerals, and particularly iron-containing sulfide minerals. By iron-containing sulfide minerals, it is meant sulfide minerals that contain iron as one of the constituents of the mineral or sulfide minerals that have been impregnated with iron, such as by iron from steel grinding media used during communication operations. Examples of some iron-containing sulfide minerals include pyritic minerals, such as pyrite, pyrrhotite and marcasite. These sulfide minerals tend to float and concentrate in the flotation concentrate, thereby enriching the flotation concentrate in both the sulfide minerals and the metallic precipitate of the nonferrous base metal. The formation of nonfloatable oxide and hydroxide precipitates is correspondingly inhibited, and preferably is substantially prevented.

In one enhanced implementation of the invention, in addition to using an oxygen-deficient flotation gas, the flotation is conducted at an acidic pH. With continued reference to FIG. 1, during the flotation processing 104, the flotation liquid is preferably maintained at an acidic pH, preferably a pH smaller than pH 6.5, and more preferably a pH smaller than pH 6. The pH of the flotation liquid will often, however, be at least pH 1, preferably at least pH 2, more preferably at least pH 3, still more preferably at least pH 4, and even more preferably at least pH 5. For many situations a particularly preferred pH range for the flotation liquid is from pH 5 to pH 6. The pH of the flotation liquid may be controlled by adding appropriate reagents, such as acid reagent e.g., sulfuric acid, or base reagent e.g., lime, prior to and/or during the flotation processing 104 as needed to maintain the pH of the flotation liquid within a desired pH range.

Another possible enhancement for implementation of the present invention is the use of a lead-containing activator reagent, such as for example lead acetate, lead nitrate or lead oxide, preferably in combination with a xanthate collector reagent, such as for example potassium ethyl xanthate, potassium amyl xanthate, sodium isobutyl xanthate or sodium isopropal xanthate. By collector reagent, it is meant a reagent that is added to impart a coating to the surface of minerals to be floated to promote attachment of mineral particles to rising bubbles of the flotation gas during flotation. By activator reagent, it is meant a reagent that is added to interact with the surface of minerals to be floated to improve the coating action of the collector reagent. By reagent, it is meant a material that is added to effect a desired chemical modification. In effecting the chemical modification, the reagent may undergo one or more chemical reactions that alter the chemical nature of the reagent in the slurry. In addition to collector and activator reagents, other reagents may be added prior to and/or during the flotation processing 104 as deemed appropriate in the particular circumstances. For example, a frother reagent may be added during and/or before the flotation. A frother reagent is any material added to help develop and/or maintain a froth at the surface of the slurry during flotation through stabilization of bubbles at the surface of the slurry, so that minerals attached to the bubbles can be easily removed with the removal of the bubbles from the froth. One example of a frother for use with the xanthate collector and lead-containing activator is methylisobutyl carbinol (MIBC).

Any suitable apparatus may be used for the flotation of the mineral material during the flotation processing 104. The flotation apparatus may comprise, for example, one or more flotation cells, flotation columns or other appropriate flotation apparatus. Preferably, the flotation apparatus should be sealed to avoid loss of the oxygen-deficient gas and to avoid introduction of oxygen gas from the ambient environment. The oxygen-deficient flotation gas may be introduced into the flotation apparatus by any suitable means for introducing and dispersing a gas, and the flotation gas may be recycled from the headspace above the slurry and reintroduced and redispersed into the slurry, thereby conserving flotation gas and reducing demand for supply of fresh flotation gas.

The feed 102 of the mineral material is preferably provided in the form of fine particulates, such as for example with a $P_{80}$ size of 150 mesh or smaller. By "$P_{80}$ size" it is meant that 80 weight percent of the particles pass the noted size. The desired fine particle size for the mineral material may be obtained, for example, by comminution, such as by grinding and/or milling, and classification, such as by screening or cycloning. The mineral material in fine particulate form may then be slurried with an aqueous liquid and subjected to any desired conditioning prior to or as part of the flotation processing 104. Conditioning may include, for example, addition of reagents. Reagents may alternatively, or additionally, be added during comminution or during the flotation. Conditioning may also include agitation of the slurry to promote homogeneity and dispersion of reagents. In one preferred implementation, such agitation during conditioning is accomplished by bubbling oxygen-deficient gas, such as described previously for the flotation gas, through the slurry, which agitation may also be aided by mechanical agitation. During the conditioning, pH adjustments may also be made to the slurry.

It should be appreciated that each of the dissolving 110 and precipitating 112 may be performed prior to and/or during actual flotation to produce the flotation concentrate 106. For example, the dissolving 110 may commence or completely occur, and the precipitating likewise may also commence or completely occur, prior to introduction of the mineral material into flotation vessels. As one example, the flotation processing 104 could include, prior to the actual flotation, subjecting a slurry of the mineral material to conditioning in a sealed vessel while oxygen-deficient gas is bubbled through the slurry to promote precipitation of the floatable precipitate. The conditioned solids, including the floatable precipitate and with reagent additions as necessary, could then be introduced into flotation vessels where the flotation gas is passed through the conditioned slurry to form a froth from which the flotation concentrate 106 is collected.

In a preferred implementation of the invention, contact of the mineral material with oxygen gas is limited beginning with comminution of the mineral material and continuing through collection of the flotation concentrate 106. In this way, nonferrous base metal dissolving into the liquid at any stage during the processing will tend to precipitate in the form of a floatable precipitate that is then retained with the solids for collection in the flotation concentrate 106.

Moreover, the flotation processing 104 may involve multiple flotation steps, combined with any variety of conditioning or other preparatory steps, and can be conducted in multiple flotation vessels. For example, the flotation processing 104 may involve flotation through a rougher-cleaner-scavenger arrangement, with or without intermediate comminution or conditioning between flotation steps. When multiple flotation steps are used, the oxygen-deficient flotation gas is preferably used in each of the flotation steps.

The mineral material in the feed 102 preferably comprises one or more base metal sulfide mineral. By base metal sulfide mineral it is meant a sulfide mineral that contains as a constituent part a nonferrous base metal. Examples of possible nonferrous base metals include one or more of copper, cadmium and cobalt. A particularly preferred nonferrous base metal for processing with the present invention is copper. Non-limiting examples of copper-containing nonferrous base metal sulfide minerals, which may be contained in the mineral material processed according to the invention, include bornite ($Cu_5FeS_4$), chalcocite ($Cu_2S$), covellite ($CuS$), digenite ($Cu_{1.8}S$), djurleite ($Cu_{1.97}S$), enargite ($Cu_3AsS_4$), tennantite ($(Cu,Fe)_{12}As_4S_{13}$), tetrahedrite ($(Cu,Fe)_{12}Sb4S_{13}$), anilite ($Cu_{1.75}S$), cubanite ($CuFe_2S_3$), famatinite ($Cu_3SbS_4$), goldfield ($Cu_{12}(Te,As)_4S_{13}$), idaite ($Cu_5FeS_6$), luzonite ($Cu_3AsS_4$) and stannite ($Cu_2FeSn_4$). In addition to nonferrous base metal-containing sulfide minerals, the mineral material feed preferably also includes pyritic sulfide minerals, for example one or more of pyrrhotite, marcasite and pyrite. Pyritic minerals, and particularly pyrite, provide a preferred substrate for loading with the floatable precipitate, and are beneficial with the present invention even though the pyritic minerals may not themselves contain any nonferrous base metal values.

The mineral material of the feed 102 contains an appreciable quantity of soluble nonferrous base metal such as soluble copper, soluble cadmium and/or soluble cobalt. In a preferred embodiment, the mineral material of the feed 102 contains appreciable quantities of soluble copper. By soluble nonferrous base metal it is meant nonferrous base metal that, as contained in the mineral material of the feed 102, is susceptible of being dissolved into the flotation liquid during the flotation processing 104.

The soluble nonferrous base metal may be contained in the mineral material of the feed 102 in any form from which the nonferrous base metal is readily dissolvable by acidic aqueous leaching. For example, some nonferrous base metal sulfide ores are stored in stockpiles for long periods of time prior to processing. During stockpiling, some amount of the sulfide minerals will naturally tend to oxidize, so that a sulfide ore that has been stockpiled may contain a larger quantity of soluble nonferrous base metal than the original ore as mined. Other ores, as mined, already have significant quantities of oxide or other minerals containing soluble nonferrous base metal.

The mineral material of the feed 102 preferably comprises a significant amount of soluble nonferrous base metal that dissolves and precipitates during the flotation processing 104, and that is collected in the flotation concentrate 106. The mineral material preferably comprises at least 0.01 weight percent (100 ppm) soluble nonferrous base metal that dissolves, precipitates and is collected in the flotation concentrate 106; frequently comprises at least 0.02 weight percent (200 ppm) soluble nonferrous base metal that dissolves, precipitates and is collected in the flotation concentrate 106; and more preferably comprises at least 0.1 weight percent (1000 ppm), at least 0.5 weight percent (5000 ppm) or even at least 1 weight percent (10,000 ppm) or more soluble nonferrous base metal that dissolves, precipitates and is collected in the flotation concentrate 106. The mineral material may contain a large proportion of soluble nonferrous base metal that dissolves, precipitates and is collected in the flotation concentrate 106, but most often the mineral material will typically comprise not greater than 20 weight percent soluble nonferrous base metal that dissolves, precipitates and is collected in the flotation concentrate 106; and more often will comprise not greater than 10 weight percent nonferrous base metal that dissolves, precipitates and is collected in the flotation concentrate 106.

Moreover, the mineral material of the feed 102 typically contains a significant quantity of insoluble nonferrous base metal. By insoluble nonferrous base metal it is meant nonferrous base metal that is in a form that does not significantly dissolve into the flotation liquid during the flotation processing 104. Insoluble nonferrous base metal in the feed 102 could include, for example, one or more of copper, nickel, zinc, cobalt and cadmium. For example, nonferrous base metals contained in sulfide minerals are often insoluble during the flotation processing 104. Also, the portion of the nonferrous base metal content that is insoluble is typically larger than the portion that is soluble. For example, the mineral material will typically include at least 0.1 weight percent (1000 ppm) of the nonferrous base metal, often at least 0.5 weight percent (5000 ppm) of the nonferrous base metal, and sometimes at least 1 weight percent (10,000 ppm), or even 3 weight percent (30,000 ppm) or more of the nonferrous base metal. But the portion of the nonferrous base metal in the mineral material that is soluble nonferrous base metal is typically less than 40 weight percent, often less than 30 weight percent, and more often less than 20 weight percent of the total nonferrous base metal in the mineral material. The soluble nonferrous base metal is, however, typically in an amount at least 1 weight percent of the total of the nonferrous base metal in the mineral material, often at least 5 weight percent of the total of the nonferrous base metal in the mineral material and frequently at least 10 weight percent of the total of the nonferrous base metal in the mineral material. The flotation concentrate 106 includes a majority of the insoluble nonferrous base metal, and typically also includes a majority of the soluble nonferrous base metal, contained in the mineral material in the feed 102 to the flotation processing.

The floatable precipitate formed during flotation processing 104 preferentially rises during flotation to be collected as part of the flotation concentrate 106, i.e., it is floatable. By being "floatable", it is meant that the precipitate either itself preferentially floats to be collected with the concentrate or is loaded onto or otherwise intimately associated with another material that preferentially floats, so that in this latter situation the precipitate is collected in the flotation concentrate 106 along with the other material. Although the nature of the floatable precipitate may not be completely understood, it appears that an oxygen-starved flotation environment using the oxygen-deficient flotation gas promotes precipitation of the soluble nonferrous base metal in elemental form on the surface of sulfide minerals. Pyritic minerals, and especially pyrite, appear to be preferential sites for deposition of this elemental nonferrous base metal precipitate, although other sulfide minerals may also serve as a substrate for the precipitate. Therefore, in a preferred embodiment, the flotation processing 104 should promote recovery of pyritic minerals, and especially pyrite, in the concentrate 106. For that reason, the flotation processing 104 will often involve bulk sulfide flotation to concentrate most or all sulfide minerals in the flotation concentrate 106.

In one implementation of the method shown in FIG. 1, the feed 102 of the mineral material is in a slurry with an aqueous liquid that contains a significant concentration of the nonferrous base metal already dissolved in the liquid. During the flotation processing 104, at least a majority, and preferably substantially all of this dissolved nonferrous base metal is precipitated in the form of the floatable precipitate and is collected with the flotation concentrate 106. As one example, all or a portion of the liquid could be from acid drainage from an ore stockpile, with the drainage containing nonferrous base metal dissolved from the stockpiled ore. As another example, the liquid may contain dissolved nonferrous base metal that was dissolved into the liquid from an ore during prior wet comminution operations. As yet another example, the liquid may comprise an acidic leach liquid from a leach operation in which soluble nonferrous base metal has been dissolved. This leaching may be for example, from the same or a different mineral material that is being processed in the flotation processing 104. Often, prior to the flotation processing the feed 102 of the flotation liquid may have dissolved therein more than 1 gram per liter of the nonferrous base metal, often more than 5 grams per liter of the nonferrous base metal and sometimes, more than 10 grams per liter of the dissolved nonferrous base metal. Following the flotation processing 104, however, the flotation liquid will typically be substantially free of the nonferrous base metal or will have dissolved therein only a small concentration of the nonferrous base metal. For example, following the flotation processing, the flotation liquid may have dissolved therein less than 0.1 gram per liter of the nonferrous base metal or even less than 0.01 gram per liter of the nonferrous base metal, and preferably less than 0.001 gram per liter of the nonferrous base metal.

An alternative implementation for the invention does not necessarily involve dissolving soluble nonferrous base metal from an ore material during flotation processing. For example, with reference to FIG. 1, if the feed 102 includes a slurry in which liquid of the slurry already contains a significant quantity of dissolved nonferrous base metal, the mineral material in the feed 102 may also contain soluble nonferrous base metal that dissolves, precipitates and is collected in the concentrate 106, as previously described. However, if the mineral material in the feed 102 does not contain any appreciable quantity of soluble nonferrous base metal, sulfide minerals in the mineral material may still provide a substrate for loading with floatable precipitate formed as the nonferrous base metal is precipitated from the flotation liquid during the flotation processing 104, with such precipitated nonferrous base metal then being collected in the flotation concentrate 106 along with the sulfide minerals. In this situation, the flotation processing would include the precipitating 112, but not the dissolving 110, because substantially all of the nonferrous base metal precipitated during the flotation processing 104 was already predissolved in the flotation liquid prior to the flotation processing.

In this regard, one aspect of the invention provides a method for removing nonferrous base metal from a solution in which the nonferrous base metal is initially dissolved, the method involves contacting the solution with a sulfide mineral material under conditions to precipitate nonferrous base metal from the solution, with the nonferrous base metal precipitate being loaded onto at least a portion of the sulfide mineral material. The sulfide mineral material preferably comprises one or more iron-containing sulfide mineral, and even more preferably one or more pyritic mineral, such as one or more of pyrite, pyrrhotite and marcasite. Pyrite, is particularly preferred as a substrate for loading with the nonferrous base metal precipitate. The conditions during the precipitating are preferably as described previously with respect to the flotation processing of FIG. 1, including an acidic solution pH, and with passing of an oxygen-deficient gas through the solution during the precipitating. The oxygen-deficient gas may for example have the same composition and attributes as the oxygen-deficient flotation gas previously described.

The solution comprises the nonferrous base metal dissolved in a liquid, typically an aqueous liquid, preferably at an acidic pH, and more preferably at an acidic pH as previously discussed for the flotation liquid described with respect to the flotation processing of FIG. 1. The nonferrous base metal may be dissolved in the liquid in a convenient salt form, such as for example in the form of a dissolved sulfate, chloride or nitrate salt, with dissolution as a sulfate salt being preferred. In one preferred variation the solution is an acidic aqueous sulfate solution.

The solution may be derived from any prior processing or operation. In one embodiment, the solution is derived from leaching nonferrous base metal from a mineral material initially containing the nonferrous base metal. The leaching may be, conducted in any convenient way, such as for example in a heap, tank, vat, autoclave or using any other technique. The leach solution will typically be an aqueous liquid, such as for example process water or an acidic aqueous solution.

Figure 2:
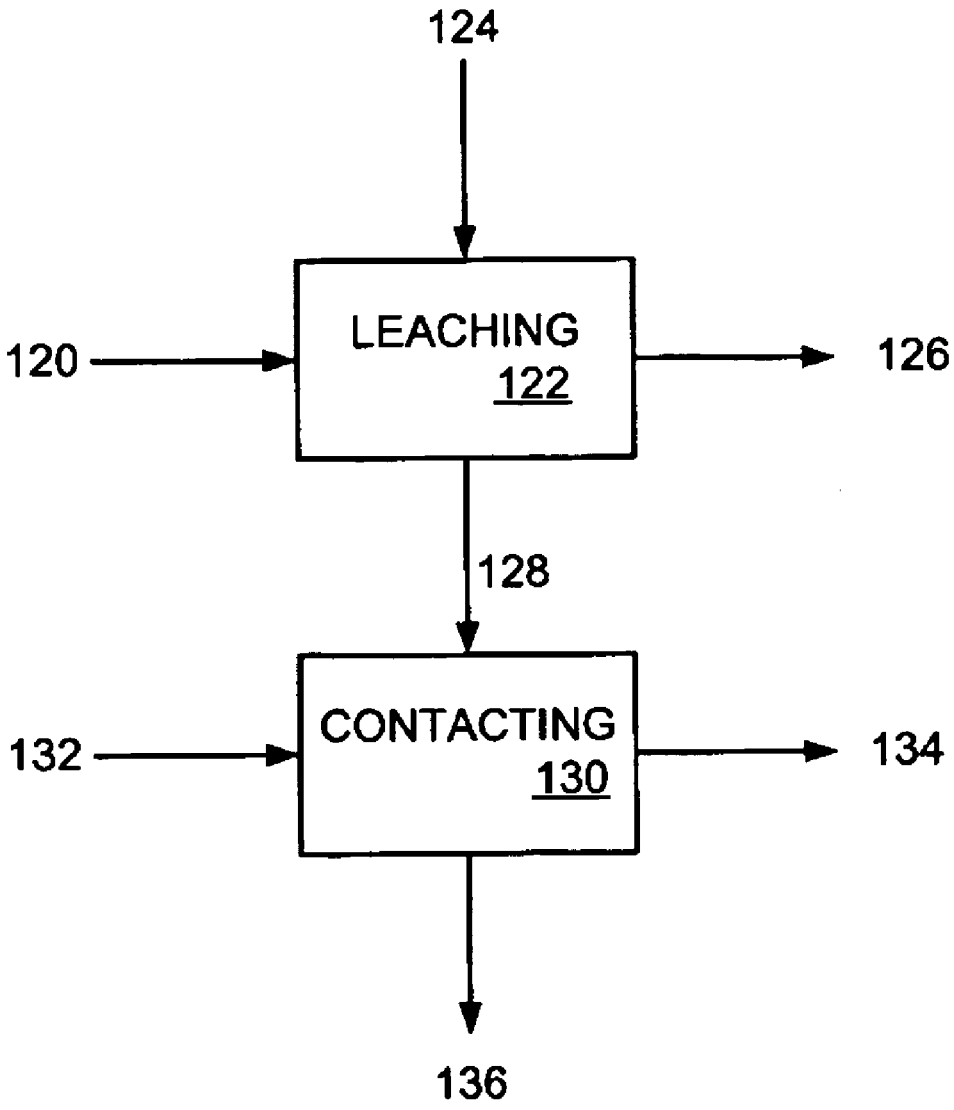
FIG. 2 illustrates a generalized process diagram of an embodiment of the present invention involving recovering dissolved nonferrous base metal from a solution in which the nonferrous base metal is initially dissolved.

As with the flotation processing previously described, one important application for this aspect of the invention involves processing of copper ores, such as for example in dump leach operations, to remove dissolved copper from pregnant acidic leach solution. Referring now to FIG. 2, a generalized process block diagram is shown for one possible implementation, which would be useful, for example, in copper dump leach operations.

As shown in FIG. 2, a feed 120 of the mineral material containing nonferrous base metal is subjected to leaching 122. A feed 124 of leach solution is supplied to the leaching 122 to contact the mineral material and dissolve nonferrous base metal from the feed 120 of the mineral material into the leach solution, producing a solid residue 126 of the mineral material and a pregnant leach solution 128 containing the dissolved nonferrous base metal. The pregnant leach solution 128 is then processed in a contacting 130 step. During the contacting 130, the pregnant leach solution 128 is contacted with a particulate sulfide mineral material 132 to promote precipitation of nonferrous base metal from the pregnant leach solution 128 and loading of precipitated nonferrous base metal onto the particulate sulfide mineral material 132. The contacting 130 preferably is conducted at an acidic pH, as previously discussed, and with passing of an oxygen-deficient gas through the solution, as previously discussed. Loaded particulate material 134, including nonferrous base metal loaded on sulfide material, may then be recovered and subjected to further processing as desired. A barren effluent 136 of the leach solution, from which the nonferrous base metal has been removed, may be treated and recycled to the leaching 122 to leach additional nonferrous base metal.

The feed 124 of the leach solution may be at any desired pH, but in one preferred embodiment is at an acidic pH, such as for example in a range of from about pH 1 to pH 6, or even in a range of from about pH 1 to pH 3. Likewise the pregnant leach solution 128 may be at any pH, but in a preferred embodiment is at an acidic pH, preferably at an acidic pH in a range of from about pH 1 to about pH 6 and more preferably of from about pH 1 to about pH 3. The pregnant leach solution 128 will typically contain 1 gram per liter, more typically at least 10 grams per liter and often at least 20 grams per liter, or even at least 30 grams per liter or more, of the dissolved nonferrous base metal. Preferred as the nonferrous base metal is one or a combination of more than one of copper, cadmium and cobalt, with copper being particularly preferred. The barren effluent 136 of the leach solution will typically contain a concentration of the dissolved nonferrous base metal that is often no larger than one-fifth (0.2), preferably no larger than one-tenth (0.1), more preferably no larger than one-hundredth (0.01), and even more preferably no larger than one-thousandth (0.001) as large as the concentration of the dissolved nonferrous base metal in the pregnant leach solution 128.

The loaded particulate material 134 may be recovered using any convenient technique, such as for example by screening, filtration, centrifuging or flotation. In one preferred variation of the implementation shown in FIG. 2, the contacting 130 involves sulfide flotation, with the loaded particulate material 134 being collected from flotation froth developing at the top of the flotation liquid. In this variation, the flotation may involve a separation of components of the particulate sulfide mineral material 132, or the flotation may be designed simply to float substantially all of the solids for recovery of the loaded particulate material 134, including the precipitated nonferrous base metal. As one example, the particulate sulfide mineral material 132 could be an ore or blend of ores containing sulfide minerals, with the loaded particulate material 134 being a sulfide concentrate, and with a tail of gangue material also being produced. As another example, the particulate sulfide mineral material 132 could be a previously prepared sulfide concentrate, and the loaded particulate material 134 could be the sulfide concentrate now loaded with the precipitated nonferrous base metal. To further elaborate on this latter example, the sulfide concentrate used as the particulate sulfide mineral material 132 could be a flotation concentrate prepared from a copper sulfide ore and the leaching 122 could be a dump leach performed on a lower-grade copper ore, or an ore with a higher content of acid leachable copper. By loading the leached copper onto a copper sulfide concentrate during the contacting 130, the need for an expensive solvent extraction and electrowinning circuit may be reduced, or even eliminated in some circumstances, for recovery of copper dissolved into a leach solution during the dump leach. Instead copper dissolved from one ore in the dump leach would be precipitated during the contacting 128 onto the sulfide concentrate made from another ore to prepare the loaded particulate material 134.

The loaded particulate material 134 may be further processed for recovery of the nonferrous base metal. For example, the loaded particulate material 134 could be processed by smelting. As another example, the loaded particulate material 134 could be subjected to biooxidation to decompose sulfide minerals and dissolve nonferrous base metal values. As yet another example, the loaded particulate material 134 could be subjected to pressure oxidation to decompose sulfide minerals and dissolve nonferrous base metal. Processing the loaded particulate material 134 by biooxidation or pressure oxidation may be accomplished by any technique for processing normal sulfide ores or concentrates containing like nonferrous base metals, such as processes that are now or may hereafter be known. An advantage of the present invention, however, is to permit recovery of the leached nonferrous base metal in a single recovery operation along with the nonferrous base metal contained in a separately prepared sulfide concentrate or a separate sulfide ore material.

These same recovery techniques discussed above for potential further processing of the loaded particulate material 134 of FIG. 2 are likewise applicable for processing of the flotation concentrate 106 of FIG. 1. If the flotation concentrate 106 (FIG. 1) or the loaded particulate material 134 (FIG. 2) include precious metal values, such as gold or silver, in the case of subsequent biooxidation or pressure oxidation processing, residual solids could then be leached with cyanide or another precious metal lixiviant for recovery of the precious metal values.

Figure 3:
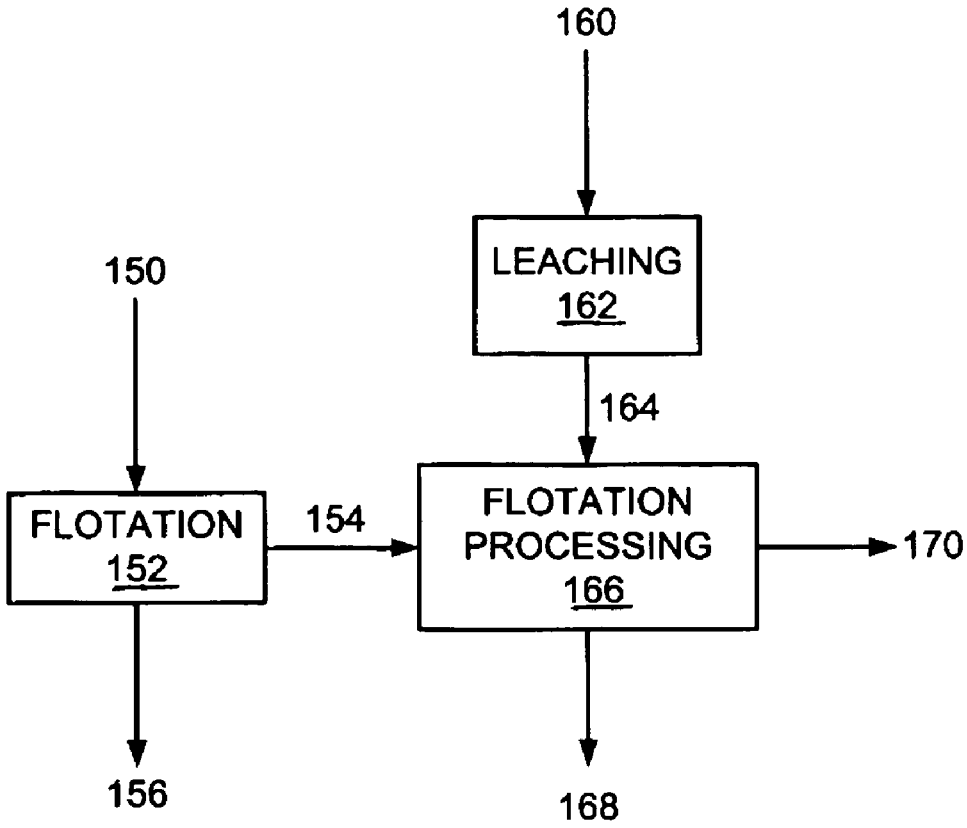
FIG. 3 illustrates a generalized process block diagram of an embodiment of the present invention involving the flotation of one material to prepare a sulfide concentrate that is used in the recovery of nonferrous base metal leached from another mineral material.

Referring now to FIG. 3, a generalized process block diagram is shown to demonstrate one implementation of the invention involving use of a sulfide concentrate prepared from one ore material as a substrate for removing nonferrous base metal from a leach solution generated by leaching another ore material. As shown in FIG. 3, first mineral material 150 is subjected to flotation 152. The first mineral material 150 contains sulfide minerals and may be, for example, a precious metal sulfide ore (i.e., primary value in ore is gold and/or silver) or a nonferrous base metal sulfide ore (i.e., primary value in ore is one or more nonferrous base metal). The flotation 152 could be operated in any suitable way to prepare a sulfide concentrate 154 enriched in one or more sulfide minerals, preferably in one or more iron-containing sulfide minerals, and more preferably in one or more pyritic minerals (and especially in pyrite), relative to the first mineral material 150. The flotation 152 also produces a flotation tail 156 depleted in one or more mineral relative to the first mineral material 150.

As shown in FIG. 3, second mineral material 160 is subjected to leaching 162, which may be at any pH, but is preferably at an acidic pH. The second mineral material 160 includes nonferrous base metal that dissolves into the leach solution during the leaching 162 to produce a pregnant leach solution 164. During flotation processing 166, the sulfide concentrate 154 is mixed with the pregnant leach solution 164 and subjected to flotation under conditions, such as previously described, to precipitate nonferrous base metal from the pregnant leach solution 164 and load precipitated nonferrous base metal onto particles of the sulfide concentrate 154, resulting in a loaded concentrate 170 and a barren leach solution 168. The flotation processing 166 may include steps other than the actual flotation, such as for example one or more conditioning steps to prepare a slurry comprising the sulfide concentrate 154 and the pregnant leach solution 164 for the actual flotation.

The foregoing descriptions of the invention with reference to FIGS. 1–3 are purposely general in nature. It should be understood that the process described with reference to any of FIGS. 1–3 could include additional steps or sub-steps not discussed. For example, comminution, thickening, washing, conditioning or other steps could be added as desired for the particular application.

EXAMPLES

A sample of coarse copper-gold sulfide ore from Papua New Guinea is stage crushed to minus 10 mesh and then kept frozen for storage. The ore is highly susceptible to oxidation and it is anticipated that as much as 10 percent of the copper content of stockpiled ore may be directly acid leachable from stockpiled ore. Preparation time for the ore is kept short to minimize exposure to air. Two head samples of the crushed ore, identified respectively as Splits A and B, are oven dried, pulverized, and assayed. A third head sample, identified as Split C, is air dried and assayed for total copper and acid soluble copper. Representative assay information for Splits A, B and C is summarized in Table 1. From assays of Splits A and B, the ore sample has a high sulfide sulfur content, averaging 10.1%. Also, only a small portion of the gold content is directly cyanide leachable. From assays of Split C, it is seen that the sample of the ore contains a significant quantity of acid soluble copper (0.61% acid soluble copper), which would be susceptible to being dissolved in flotation liquid and lost during conventional flotation processing. Based on the soluble copper content determined for Split C and the total copper contents determined for Splits A, B and C, about 18% of the copper in the sample of the ore is acid soluble.

TABLE 1

Representative Assay Information

| | Gold | | Copper | | | Iron | Sulfur | |
|---|---|---|---|---|---|---|---|---|
| | | Cyanide | | Acid | Cyanide | | | |
| Head Split | g/tonne | Soluble (g/tonne) | Total (wt. %) | Soluble (wt. %) | Soluble (wt. %) | Total (wt. %) | Total (wt. %) | Sulfide (wt. %) |
| A | 2.39 | 0.60 | 3.29 | | | 11.55 | 13.65 | 9.98 |
| B | 2.95 | 0.58 | 3.37 | | | 10.75 | 13.76 | 10.21 |
| C | | | 3.46 | 0.61 | 3.01 | | | |
| Average | 2.67 | 0.59 | 3.37 | 0.61 | 3.01 | 11.15 | 13.71 | 10.10 |

Four tests are performed. For each test, a 1000 gram sample of the ore is ground with the addition of approximately 12.5 grams of soluble copper sulfate reagent ($CuSO_4.5\ H_2O$) to a size of about 80% passing 17 microns. The grinding is performed in a laboratory rod mill operating at about 71 revolutions per minute with the ore sample in a slurry containing about 50 weight % of solids in water. The copper sulfate reagent is added in an amount to provide copper in solution that is approximately equal to 10% solubilization of copper, to simulate solubilization of copper from stockpiled ore. The ground slurry is subjected to laboratory flotation to evaluate in particular recovery of soluble copper (including the soluble copper added as copper sulfate reagent and the soluble copper already present in the ore sample). In a laboratory flotation cell, the slurry is subjected to conditioning for pH adjustment and flotation reagent addition while a gas is bubbled through the slurry. Following the conditioning sequence, four 5-minute stages of rougher flotation are conducted in the laboratory flotation cell (for a total of 20 minutes of rougher flotation). Chemical reagents used in the tests are listed in Table 2. At the end of each five-minute rougher flotation segment, the flotation gas is turned off and remaining froth is removed from the top of the slurry. Bubbling of the flotation gas is then commenced to start the next five-minute rougher flotation segment. The flotation gas bubbled through the slurry during the rougher flotation is either air or industrial grade nitrogen gas. Frother reagent is added as needed to maintain good froth characteristics during the rougher flotation. The same gas used for flotation is bubbled through the slurries during conditioning steps. For tests involving nitrogen gas flotation, nitrogen gas is also flushed through the rod mill during the milling operation, so that each step of the nitrogen gas tests is performed in an environment that is in the absence of the oxygen gas normally present in air.

The conditions for each of the four tests are summarized in Tables 3–6. In Tables 3–6, "Cond" refers to a conditioning stage and "Ro" refers to a rougher flotation stage. "Eh" refers to slurry electrical potential measured relative to a Ag—Ag/Cl electrode using a platinum working electrode.

TABLE 2

Test Reagents

| Reagent | Function | Description |
|---|---|---|
| PAX | collector | potassium amyl xanthate |
| $Pb\ (NO_3)_2$ | activator | lead nitrate |

TABLE 2-continued

Test Reagents

| Reagent | Function | Description |
|---|---|---|
| AEROFL | promoter | Sodium AEROFLOAT ™ - dithiophosphate reagent, from Cytec |
| MBIC | frother | methyl isobutyl carbinol |
| DF250 | frother | DOWFROTH ™ 250 - polypropylene glycol methyl ether reagent, from Dow Chemical Company |
| $H_2SO_4$ | PH adjustment | sulfuric acid |
| $Ca(OH)_2$ | PH adjustment | calcium hydroxide (slaked lime) |

TABLE 3

| Test 1 Conditions | | | | | | | | | |
|---|---|---|---|---|---|---|---|---|---|
| | Reagent Additions (g/tonne) | | | | | Time | | Eh | |
| Stage | Pb $(NO_3)_2$ | PAX | $H_2SO_4$ | MIBC | DF250 | (min) | pH | (mV) | Gas |
| Grind | | | | | | 18 | 6.46 | −426 | $N_2$ |
| Cond | 100 | | 2200 | | | 3 | 5.5 | −395 | $N_2$ |
| Cond | | 100 | | | | 1 | 5.5 | −380 | $N_2$ |
| Ro 1 | | | | 20 | | 5 | 5.5 | −370 | $N_2$ |
| Ro 2 | | 50 | | 20 | 20 | 5 | 5.5 | −280 | $N_2$ |
| Ro 3 | | 50 | | | 12 | 5 | 5.5 | −177 | $N_2$ |
| Ro 4 | | 50 | | | 20 | 5 | 5.5 | −50 | $N_2$ |
| Total | 100 | 250 | 2200 | 40 | 52 | | | | |

TABLE 4

| Test 2 Conditions | | | | | | | | | |
|---|---|---|---|---|---|---|---|---|---|
| | Reagent Additions (g/tonne) | | | | | | | | |
| Stage | Pb $(NO_3)_2$ | PAX | $H_2SO_4$ | MIBC | DF 250 | Time (min) | pH | Eh (mV) | Gas |
| Grind | | | | | | 18 | 6.4 | | $N_2$ |
| Cond | | | 4500 | | | 3 | | | $N_2$ |
| Cond | | 100 | | | | 1 | 5.5 | −401 | $N_2$ |
| Ro 1 | | | | 20 | 8 | 5 | 5.5 | −451 | $N_2$ |
| Ro 2 | | 50 | | 20 | 20 | 5 | 5.5 | −406 | $N_2$ |
| Ro 3 | | 50 | | | 28 | 5 | 5.5 | −141 | $N_2$ |
| Ro 4 | | 50 | | | 28 | 5 | 5.5 | 50 | $N_2$ |
| Total | 0 | 250 | 4500 | 40 | 84 | | | | |

TABLE 5

| Test 3 Conditions | | | | | | | |
|---|---|---|---|---|---|---|---|
| | Reagent Additions (g/tonne) | | | Time | | Eh | |
| Stage | AEROFL | MIBC | DF250 | (min) | pH | (mV) | Gas |
| Grind | | | | 18 | 6.21 | −200 | Air |
| Cond | 100 | 20 | | 1 | 6.52 | −234 | Air |
| Ro 1 | | | 16 | 5 | 4.62 | 141 | Air |
| Ro 2 | 50 | | 8 | 5 | 4.57 | 133 | Air |
| Ro 3 | 50 | | 16 | 5 | 4.41 | 150 | Air |
| Ro 4 | 50 | | 8 | 5 | 4.4 | 154 | Air |
| Total | 250 | 20 | 48 | | | | |

Tests 1 and 2 are performed using nitrogen as the flotation gas, and include the addition of sulfuric acid to adjust the pH of the flotation liquid to about pH 5.5. The conditions for Tests 1 and 2 are shown in Tables 3 and 4, respectively. A difference between Test 1 and Test 2 is that a lead-containing activator is used in Test 1, but not in Test 2. Tests 3 and 4 are comparative tests performed using air as the flotation gas. The conditions for Tests 3 and 4 are shown in Tables 5 and 6, respectively. In Test 3, the flotation is conducted at a natural pH, i.e., no addition of acid or base, and pH of the flotation liquid drops as the test continues from about pH 6.2 initially to about pH 4.4 at the end. In Test 4, calcium hydroxide, in the form of slaked lime, is added to adjust and maintain liquid pH at about pH 8.5.

TABLE 6

| Test 4 Conditions | | | | | | | | |
|---|---|---|---|---|---|---|---|---|
| | Reagent Additions (g/tonne) | | | | | | | |
| Stage | AEROFL | $Ca(OH)_2$ | MIBC | DF250 | Time (min) | pH | Eh (mV) | Gas |
| Grind | | 1500 | | | 18 | 6.50 | −200 | Air |
| Cond | 100 | 4350 | 12 | | 1 | | | Air |
| Ro 1 | | | | | 5 | 8.47 | 43 | Air |
| Ro 2 | 50 | 336 | 12 | 4 | 5 | 8.76 | 35 | Air |
| Ro 3 | 50 | | 8 | 4 | 5 | 8.75 | 35 | Air |
| Ro 4 | 50 | | 8 | 4 | 5 | 8.58 | 44 | Air |
| Total | 250 | 6186 | 40 | 12 | | | | |

Results of Tests 1–4 are summarized in Tables 7 and 8. Table 7 summarizes data concerning the flotation concentrate and flotation tail solids for each test. Table 8 summarizes assay information concerning dissolved copper and dissolved iron content in the final flotation liquid for Tests 2–4.

TABLE 7

Flotation Test Results

| | Combined Concentrates | | | | | | | | | | Final Tail Assays | | | |
|---|---|---|---|---|---|---|---|---|---|---|---|---|---|---|
| | | | Concentrate Assays | | | | Recoveries in Concentrate (%) | | | | | | | |
| | | Weight | Acid | | | | | | | | | Acid | | |
| Test No. | Cum. Float Time (min) | Recovery in Concentrate (wt. %) | Total Copper Content (wt. %) | Soluble Copper Content (wt. %) | Gold Content (g/tonne) | Iron Content (wt. %) | Total Copper | Acid Soluble Copper | Gold | Iron | Copper (wt. %) | Soluble Copper (wt. %) | Gold (g/tonne) | Iron (wt. %) |
| 1 | 5 | 13.81 | 9.89 | 3.62 | 6.03 | 33.14 | 38.2 | 56.7 | 36.3 | 44.6 | | | | |
| | 10 | 26.75 | 9.44 | 2.58 | 5.00 | 28.70 | 70.6 | 78.1 | 58.3 | 74.9 | | | | |
| | 15 | 34.50 | 9.58 | 2.37 | 4.85 | 25.67 | 92.4 | 92.9 | 72.9 | 86.4 | | | | |
| | 20 | 38.10 | 9.19 | 2.23 | 4.69 | 24.07 | 97.9 | 96.5 | 77.8 | 89.4 | 0.12 | 0.05 | 0.82 | 1.75 |
| | Calculated Feed | | 3.58 | 0.88 | 2.29 | 10.25 | | | | | | | | |
| 2 | 5 | 6.53 | 12.06 | 4.90 | 7.46 | 27.20 | 21.6 | 37.3 | 20.2 | 17.0 | | | | |
| | 10 | 18.16 | 9.13 | 2.84 | 5.62 | 29.90 | 45.5 | 60.3 | 42.3 | 52.1 | | | | |
| | 15 | 32.63 | 10.18 | 2.43 | 5.01 | 27.12 | 91.2 | 92.7 | 67.7 | 85.0 | | | | |
| | 20 | 36.76 | 9.68 | 2.26 | 4.86 | 25.41 | 97.7 | 97.0 | 74.0 | 89.7 | 0.13 | 0.04 | 0.99 | 1.70 |
| | Calculated Feed | | 3.64 | 0.86 | 2.42 | 10.42 | | | | | | | | |
| 3 | 5 | 12.8 | 16.79 | 2.60 | 6.71 | 24.27 | 58.8 | 44.2 | 35.1 | 30.4 | | | | |
| | 10 | 23.82 | 12.47 | 2.04 | 5.57 | 26.68 | 81.2 | 64.5 | 54.3 | 62.3 | | | | |
| | 15 | 29.18 | 11.05 | 1.98 | 5.15 | 26.19 | 88.1 | 76.7 | 61.5 | 74.9 | | | | |
| | 20 | 31.75 | 10.44 | 1.92 | 5.05 | 25.34 | 90.7 | 80.9 | 65.6 | 78.8 | 0.50 | 0.21 | 1.23 | 3.17 |
| | Calculated Feed | | 3.66 | 0.75 | 2.44 | 10.21 | | | | | | | | |
| 4 | 5 | 6.51 | 13.68 | 3.42 | 7.54 | 34.80 | 25.9 | 24.5 | 22.9 | 21.3 | | | | |
| | 10 | 26.74 | 10.88 | 2.37 | 4.74 | 27.08 | 84.7 | 69.6 | 59.2 | 68.1 | | | | |
| | 15 | 30.53 | 10.08 | 2.3 | 4.50 | 27.74 | 89.6 | 77.3 | 64.2 | 79.6 | | | | |
| | 20 | 32.05 | 9.74 | 2.27 | 4.43 | 26.87 | 90.9 | 79.8 | 66.3 | 81.0 | 0.46 | 0.27 | 1.06 | 2.98 |
| | | | 3.43 | 0.91 | 2.14 | 10.64 | | | | | | | | |

As seen in Table 7 relative to Tests 3 and 4, the weight recoveries in the concentrate are higher for Tests 1 and 2, and both copper and gold recoveries in the concentrate are higher for Tests 1 and 2. Approximately 7% more of the total copper is recovered in the concentrate for each of Tests 1 and 2 than for either of Tests 3 and 4. Of particular note, recoveries in the concentrate of the acid soluble portion of the copper are more than 15% larger for tests 1 and 2 than for Tests 3 and 4. Reference to the tail assays shown in Table 7 shows that the flotation of each of Tests 1 and 2 is successful at reducing the amount of copper lost to the tail relative to each of Tests 3 and 4. Of particular interest, however, is the dramatic reduction in the amount of soluble copper reporting to the tail in each of Tests 1 and 2 relative to Tests 3 and 4. Also, as seen in Table 8, the flotation of Test 2 is successful at virtually eliminating soluble copper from the flotation liquid, whereas Tests 3 and 4 are not. Operation of Test 4 at an alkaline pH does lower the concentration of copper from the final flotation liquid relative to Test 3, but it is apparent for both Tests 3 and 4 that precipitated soluble copper reports largely to the flotation tail, representing lost value. In contrast, the low soluble copper assay in the flotation tail for Test 2 indicates that in that test, soluble copper precipitated from the flotation liquid largely reports to the concentrate. Moreover, it is noted that the final flotation liquid of Test 2 contains no identifiable dissolved iron, compared to the large dissolved iron concentrations for Tests 3 and 4.

TABLE 8

Final Flotation Liquid Assays

| Test | Cu mg/L | Fe mg/L |
|---|---|---|
| 2 | 0.02 | 0.00 |
| 3 | 39 | 636 |
| 4 | 0.45 | 917 |

The low levels of dissolved copper and iron in the final flotation liquid are beneficial for water treatment prior to discharge or for recycle in process operations.

The foregoing discussion of the invention has been presented for purposes of illustration and description. The foregoing is not intended to limit the invention to only the form or forms specifically disclosed herein. Although the description of the invention has included description of one or more embodiments and certain variations and modifications, other variations and modifications are within the scope of the invention, e.g., as may be within the skill and knowledge of those in the art after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter. Furthermore, any feature described with respect to any disclosed embodiment may be combined in any combination with one or more features of any other embodiment or embodiments. For example, additional processing steps can be included at any point during or after processing disclosed in any of the process embodiments described herein or shown in any of the figures, so long as the additional steps are not incompatible with the disclosed processing according to the present invention. Moreover, processing steps disclosed in any of the process embodiments described herein can be combined with any other processing steps disclosed in the figures.

What is claimed is:

1. A method for processing a mineral material containing nonferrous base metal, at least a portion of the nonferrous base metal being soluble nonferrous base metal, the method comprising flotation processing of the mineral material, the flotation processing comprising:

passing flotation gas through a slurry comprising particles of the mineral material slurried in a flotation liquid, a first portion of the particles rising with the flotation gas through the flotation liquid and being collected in a flotation concentrate enriched in the nonferrous base metal relative to the mineral material, a second portion of the particles being collected as a flotation tail that is depleted in the nonferrous base metal relative to the mineral material, the flotation gas comprising no more than 15 percent oxygen gas;

dissolving from the mineral material and into the flotation liquid at least a majority of the soluble nonferrous base metal; and precipitating in the form of a floatable precipitate at least a majority of the soluble nonferrous base metal dissolved during the dissolving; and collecting at least a majority of the floatable precipitate in the flotation concentrate, wherein the flotation concentrate is enriched in and the flotation tail is depleted in the soluble nonferrous base metal relative to the mineral material.

2. The method of claim 1, wherein the dissolving commences prior to the passing flotation gas through the slurry.

3. The method of claim 1, wherein at least a portion of the precipitating occurs during the passing flotation gas through the slurry.

4. The method of claim 1, wherein the flotation gas comprises at least 85 volume percent inert gas.

5. The method of claim 4, wherein the flotation gas comprises at least 85 volume percent nitrogen gas.

6. The method of claim 4, wherein the flotation gas comprises no more than 5 volume percent oxygen gas.

7. The method of claim 1, wherein the mineral material comprises sulfide mineral material and the flotation concentrate is a sulfide concentrate enriched in the sulfide mineral material relative to the mineral material.

8. The method of claim 7, wherein the sulfide mineral material comprises one or more iron-containing sulfide mineral serving as a substrate for precipitation of the nonfloatable precipitate, and the flotation concentrate is enriched in the one or more iron-containing sulfide mineral relative to the mineral material.

9. The method of claim 8, wherein the sulfide mineral material comprises one or more nonferrous base metal sulfide mineral and the flotation concentrate is enriched in the one or more nonferrous base metal sulfide mineral relative to the mineral material.

10. The method of claim 9, wherein the nonferrous base metal comprises copper and the one or more nonferrous base metal sulfide mineral comprises one or more of chalcopyrite chalcocite, covellite and bornite.

11. The method of claim 7, wherein the floatable precipitate comprises the soluble nonferrous base metal in elemental form loaded on the sulfide mineral material.

12. The method of claim 11, wherein the sulfide mineral material comprises pyrite, during the precipitating the floatable precipitate preferentially deposits on the pyrite, and the flotation concentrate is enriched in the pyrite relative to the mineral material.

13. The method of claim 1, wherein during the passing the flotation gas through the slurry, the flotation liquid is at an acidic pH.

14. The method of claim 13, wherein the acidic pH is no larger than pH 6.5.

15. The method of claim 14, wherein the acidic pH is in a range of from pH 2 to pH 6.5.

16. The method of claim 15, wherein prior to the dissolving and the precipitating, the flotation liquid comprises in solution a first concentration of the nonferrous base metal of at least 1 gram per liter.

17. The method of claim 16, wherein after the precipitating, the flotation liquid comprises in solution a second concentration of the nonferrous base metal that is no larger than one-tenth of the first concentration.

18. The method of claim 1, wherein the mineral material comprises at least 200 ppm of soluble copper that dissolves into the flotation liquid during the dissolving, precipitates in the form of the floatable precipitate during the precipitating and is collected as part of the flotation concentrate during the collecting.

19. The method of claim 1, wherein the mineral material comprises at least 0.1 weight percent of soluble copper that dissolves into the flotation liquid during the dissolving, precipitates in the form of the floatable precipitate during the precipitating, and is collected as part of the flotation concentrate during the collecting.

20. The method of claim 1, wherein the mineral material comprises from 0.1 weight percent to 10 weight percent of the soluble nonferrous base metal that dissolves into the flotation liquid during the dissolving, precipitates in the form of the floatable precipitate during the precipitating and is collected as part of the flotation concentrate during the collecting.

21. The method of claim 20, wherein the flotation gas comprises no more than 10 volume percent oxygen gas and at least 90 volume percent inert gas.

22. The method of claim 21, wherein during the passing flotation gas through the slurry, the flotation liquid is at a pH in a range of from pH 2 to pH 6.5.

23. The method of claim 22, wherein the floatable precipitate comprises the soluble nonferrous base metal in metallic form, and the precipitating comprises depositing the floatable precipitate on sulfide mineral material that is concentrated in the flotation concentrate.

24. The method of claim 23, wherein the sulfide mineral material comprises one or more iron-containing sulfide mineral, and the one or more iron-containing sulfide mineral serves as a preferential substrate for the floatable precipitate.

25. The method of claim 22, wherein:

prior to the dissolving and the precipitating, the flotation liquid contains in solution a first concentration of the nonferrous base metal; and after the dissolving and the precipitating, the flotation liquid contains in solution a second concentration of the nonferrous base metal that is no larger than one-tenth of the first concentration.

26. The method of claim 25, comprising:

prior to the flotation processing, leaching into an aqueous leach liquid a quantity of the nonferrous base metal; and after the leaching, mixing the leach liquid with the mineral material, the leach liquid forming at least a part of the flotation liquid.

27. The method of claim 1, comprising leaching the flotation concentrate with a leach liquid to dissolve at least a portion of the nonferrous base metal from the flotation concentrate.

28. The method of claim 27, wherein the leaching comprises pressure oxidizing the flotation concentrate.

29. The method of claim 27, comprising, after the leaching, removing at least a portion of the nonferrous base metal from the leach solution and preparing a purified product comprising the nonferrous base metal.

30. The method of claim 29, wherein the removing comprises solvent extraction.

31. The method of claim 1, comprising contacting the mineral material with a lead-containing activator prior to or during the flotation processing.

32. The method of claim 31, comprising contacting the mineral material with a xanthate collector prior to or during the flotation processing.

33. The method of claim 1, wherein the nonferrous base metal comprises copper.

34. The method of claim 1, wherein the nonferrous base metal comprises one or more of cobalt and cadmium.

35. A method for removing dissolved nonferrous base metal from an aqueous liquid in which the nonferrous base metal is dissolved, the method comprising:

contacting the liquid containing the dissolved nonferrous base metal with sulfide mineral material;

during the contacting, precipitating from the liquid at least a portion of the nonferrous base metal and loading onto the sulfide mineral material a precipitate containing at least a portion of the nonferrous base metal precipitated from the solution;

during the precipitating, passing a gas through the liquid, the gas comprising no more than 15 volume percent oxygen gas; and separating from the liquid sulfide mineral material loaded with the precipitate.

36. The method of claim 35, wherein during the precipitating, the gas comprises at least 90 volume percent inert gas.

37. The method of claim 35, wherein the separating comprises removing the sulfide mineral material loaded with the precipitate from froth forming at the surface of the liquid during the passing the gas through the liquid.

38. The method of claim 35, wherein the liquid is at an acidic pH in a range of from pH2 to pH 6.5.

39. A method for recovering nonferrous base metal from a mineral material, the method comprising:

leaching nonferrous base metal from the mineral material into an aqueous leach solution;

after the leaching, contacting the leach solution with sulfide mineral material while passing a gas through the leach solution, the gas comprising no more than 15 volume percent oxygen gas, during the contacting, at least a majority of the nonferrous base metal leached into the leach solution during the leaching precipitates from the leach solution and forms a precipitate associated with the sulfide mineral material;

separating the sulfide mineral material and the precipitate associated with the sulfide mineral material from the leach solution.

40. The method of claim 39, wherein the sulfide mineral material is a sulfide concentrate.

41. The method of claim 40, wherein the mineral material is a first mineral material and the sulfide concentrate is a flotation concentrate prepared from a second mineral material.

42. The method of claim 41, wherein:

when introduced into the contacting, the sulfide mineral material is part of an ore material;

during the contacting, the ore material is separated by flotation into a flotation concentrate enriched in sulfide minerals relative to the ore material and a flotation tail depleted in sulfide minerals relative to the ore material; and the separating comprises collecting the flotation concentrate from froth forming at the top of the leach liquid during the contacting.

43. The method of claim 39, wherein the leach solution is at a pH of from pH 2 to pH 6 during the contacting.

44. The method of claim 43, wherein the leach solution is at a lower pH during the leaching than during the contacting, and the method comprises adjusting the pH of the leach solution between the leaching and the contacting.

45. The method of claim 39, wherein the nonferrous base metal comprises copper.

46. The method of claim 45, wherein:

the leach solution has a first concentration of the nonferrous base metal after the leaching and prior to the contacting; and the leach solution has a second concentration of the dissolved nonferrous base metal following the contacting, the second concentration being no larger than one-tenth of the first concentration.

47. The method of claim 46, wherein the first concentration is larger than 1 gram per liter of the nonferrous base metal in the leach solution.

* * * * *